US006030039A

United States Patent [19]

Essler

[11] Patent Number: 6,030,039

[45] **Date of Patent: *Feb. 29, 2000**

[54] RIM CHAIR

[76] Inventor: Kirk Gregory Essler, 1536 Merced St., Richmond, Calif. 94804

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,322

[22] Filed: Sep. 26, 1997

[51] Int. Cl.[7] ..... A47C 9/00

[52] U.S. Cl. ..... 297/273; 4/241; 128/845; 600/38

[58] Field of Search ..... 297/273, 339, 297/DIG. 10, 274, 275, 276, 277, 281; 4/667, 241, 237; 5/929; 128/845; 600/38

[56] References Cited

U.S. PATENT DOCUMENTS

| | | | |
|---|---|---|---|
| 362,969 | 5/1887 | Jacobus | 4/237 X |
| 656,763 | 8/1900 | Belisle | 297/276 X |
| 663,826 | 12/1900 | Baker | 4/237 X |
| 1,132,939 | 3/1915 | Jaubard | 4/237 |
| 1,256,548 | 2/1918 | Gannon | 297/275 |
| 1,557,263 | 10/1925 | Millen | 297/274 X |
| 1,698,344 | 1/1929 | Mott | 297/339 |
| 1,950,042 | 3/1934 | Upper | 297/274 X |
| 2,533,019 | 12/1950 | Ketcham | 297/275 X |
| 3,765,674 | 10/1973 | Siler | 297/273 X |
| 3,971,592 | 7/1976 | Farley | 297/448.2 |
| 4,825,855 | 5/1989 | Kundson, Jr. | 600/38 |
| 4,877,238 | 10/1989 | Barrett | 297/274 X |
| 4,907,303 | 3/1990 | Baird | 297/339 X |
| 4,924,531 | 5/1990 | Square | 297/DIG. 10 X |
| 4,941,708 | 7/1990 | Heffner | 297/DIG. 10 X |
| 5,027,446 | 7/1991 | Robertson | 297/DIG. 10 X |
| 5,226,439 | 7/1993 | O'Keefe et al. | 297/DIG. 10 X |
| 5,251,862 | 10/1993 | Raymond | 297/DIG. 10 X |
| 5,294,176 | 3/1994 | Asinovsky | 297/245 |
| 5,312,157 | 5/1994 | Logan, Jr. | 297/DIG. 10 X |
| 5,526,893 | 6/1996 | Higer | 297/273 X |
| 5,690,383 | 11/1997 | Meeker | 297/274 |
| 5,704,882 | 1/1998 | Coates et al. | 297/273 X |
| 5,737,780 | 4/1998 | Okita et al. | 4/667 |
| 5,782,243 | 7/1998 | Bisyak | 128/845 |

FOREIGN PATENT DOCUMENTS

| | | | |
|---|---|---|---|
| 131731 | 11/1947 | Australia | 297/281 |
| 629927 | 10/1961 | Canada | 297/274 |
| 294172 | 4/1965 | Netherlands | 4/237 |
| 616403 | 9/1947 | United Kingdom | 4/237 |
| 1286716 | 8/1972 | United Kingdom | 297/274 |
| 2077114 | 12/1981 | United Kingdom | 297/274 |

*Primary Examiner*—Peter M. Cuomo
*Assistant Examiner*—David E. Allred
*Attorney, Agent, or Firm*—Victoria S. Kolakowski

[57] ABSTRACT

The present invention therefore comprises a chair for supporting a person during sexual activity. The chair comprises a seat having an opening in the middle to permit access to a seated person's genitals or anus. The chair also comprises a rigid support frame for supporting the seat, and a flexible support system connected to the seat and the rigid support frame for suspending the seat from the rigid support frame. In a preferred embodiment of the present invention, the flexible support system comprises a plurality of springs connected to the rigid support frame and the seat.

In an alternative embodiment of the present invention, the chair comprises the seat and flexible support system, which connects to the seat and to an existing rigid support structure.

10 Claims, 2 Drawing Sheets

RIM CHAIR

FIELD OF THE INVENTION

The present invention relates to devices to assist in sexual intercourse and other sexual activity, and more particularly to devices for positioning a person during sexual activity.

BACKGROUND OF THE INVENTION

Sexual intercourse, and other types of sexual activity, are among the most basic actions performed by all higher life, but human beings are unique in intentionally engaging in sexual acts for pleasure, and not simply for procreation. In furtherance of such pleasure, people have long devised a range of apparatus to increase the pleasure of the sexual acts, to minimize discomfort and to increase the range of available sexual acts.

One of the more difficult problems encountered during sexual intercourse and other sexual activity is that of positioning the participants in positions that are comfortable and yet which permits, or preferably assists in, the performance of a variety of sexual acts by the participants, such as oral-genital sexual activity. In response to this problem, specially constructed beds, hammock-like slings and specially constructed chairs have long been constructed to permit the participants greater freedom in position during the sexual acts.

One such chair is commonly known as the "rim chair" or "rim stool". In the most common and easily constructed configuration, this is essentially an ordinary toilet seat with legs attached to the bottom to permit one partner to remain seated during sexual activity. The legs are positioned such that there is free space beneath the seat, and the seat is open in the middle and often in the front. Hence, the seat permits easy access to the genitals and anus of the seated partner.

Unfortunately, this configuration is very rigid. The legs must be firmly attached to the seat to ensure that the seat does not collapse during the sexual acts, thereby injuring the participants. The legs may even be attached to the floor to improve stability. However, this rigidity can create physical discomfort in the participants, and provides only limited freedom in positioning the parties.

Hence, it would be desirable to construct a rim chair which provides the needed structural support for the participants while allowing greater flexibility for motion of the seated partner.

SUMMARY OF THE INVENTION

It is an object of this invention to provide an improved rim chair which has both the necessarily structural stability as well as some flexibility of motion of the seat.

The present invention therefore comprises a chair for supporting a person during sexual activity. The chair comprises a seat having an opening in the middle to permit access to a seated person's genitals or anus. The chair also comprises a rigid support frame for supporting the seat, and a flexible support system connected to the seat and the rigid support frame for suspending the seat from the rigid support frame. In a preferred embodiment of the present invention, the flexible support system comprises a plurality of springs connected to the rigid support frame and the seat.

In an alternative embodiment of the present invention, the chair comprises the seat and flexible support system, which connects to the seat and to an existing rigid support structure.

DETAILED DESCRIPTION OF THE INVENTION

Figure 1:
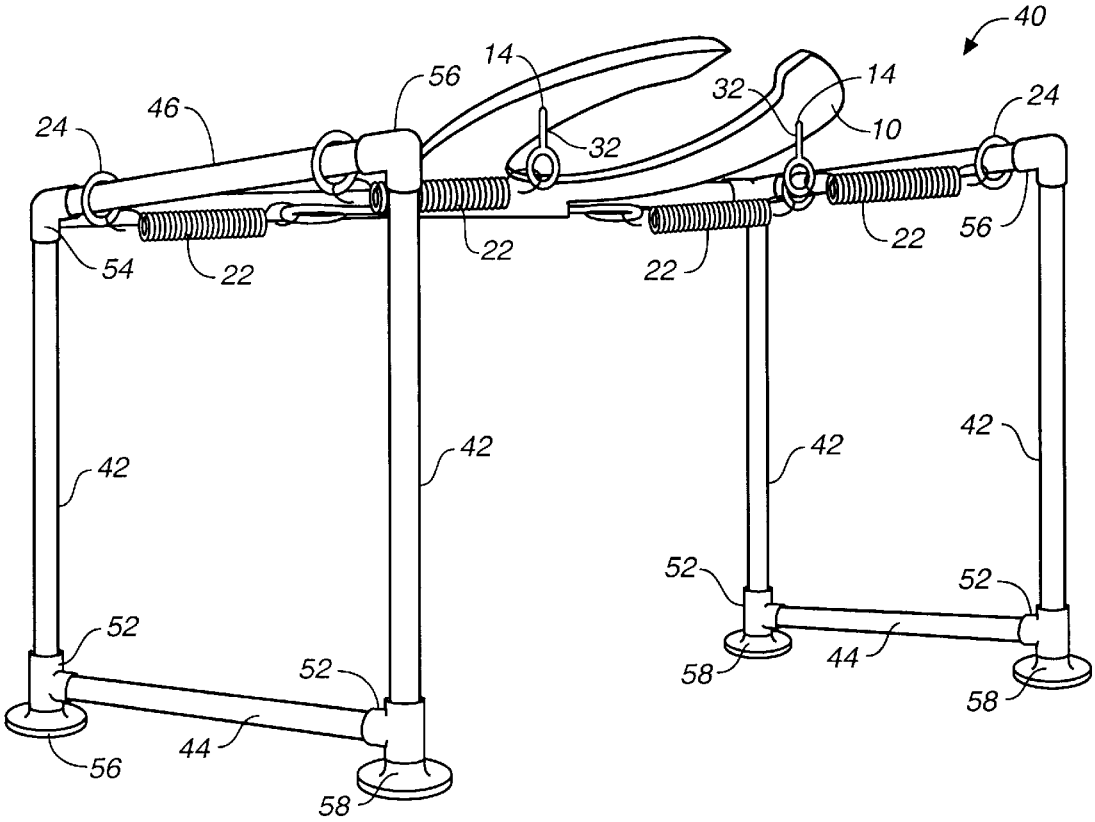
FIG. 1 is a perspective view of a presently preferred embodiment of the present invention.

A presently preferred embodiment of the apparatus of the invention is shown in FIG. 1. The embodiment shown comprises three major components, with a seat 10 being attached to a rigid support frame 40 by means of a flexible support system 20. This attachment is such that a person seated on seat 10 is supported by rigid support frame 40, while flexible support system 20 permits a degree of movement of the seat as discussed below.

In the embodiment of the present invention illustrated in FIG. 1, seat 10 comprises an ordinary toilet seat. While any of a variety of toilet seats may be used in this fashion, the presently preferred embodiment is of the sort having an open front, such that it is more of a "C" or "U" shape, as opposed to a closed annular design. This configuration permits greater access to the genitals of the seated party. However, while presently preferred embodiments use a toilet seat, any of a variety of seats with an opening in the middle may be used.

Figure 2:
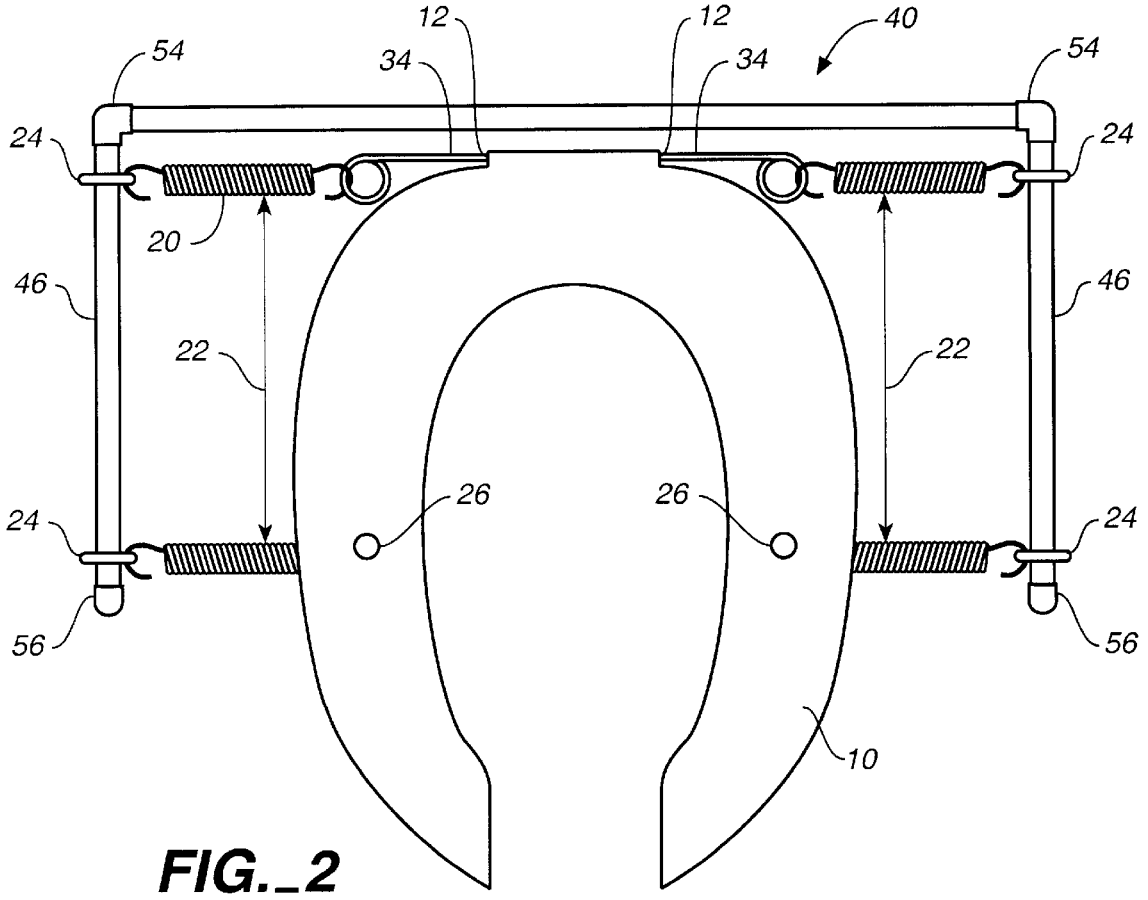
FIG. 2 is a top view of the embodiment of the present invention which is illustrated in FIG. 1.
Figure 3:
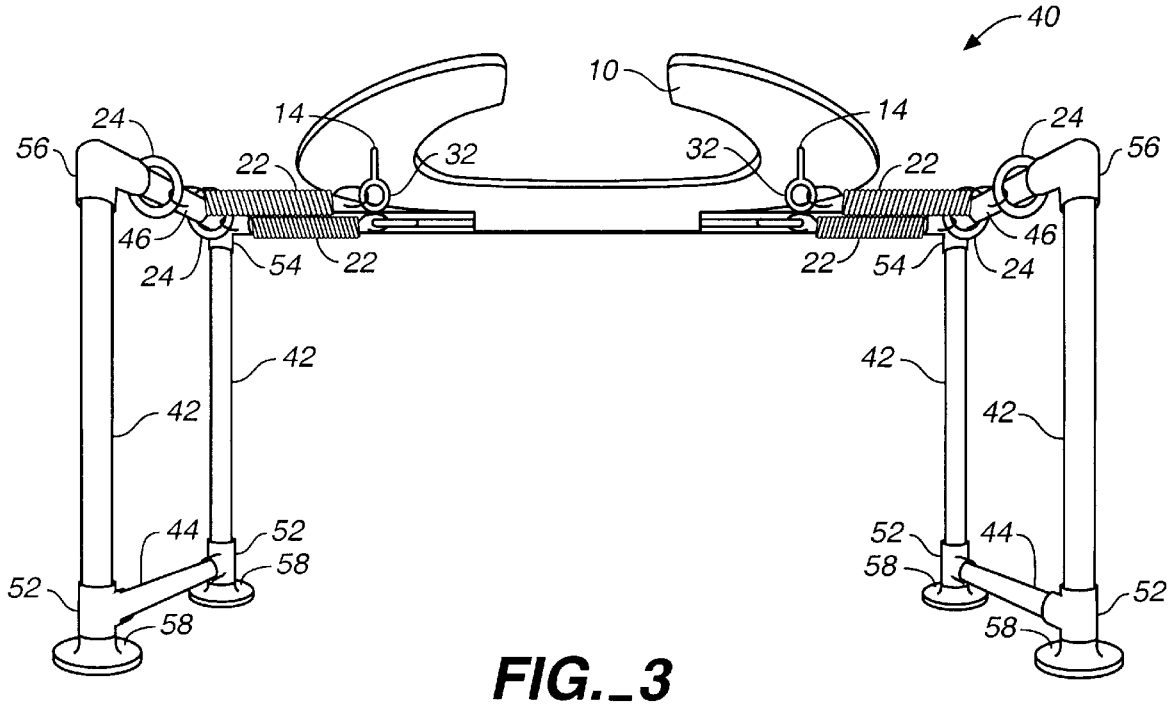
FIG. 3 is a front view of the embodiment of the present invention which is illustrated in FIG. 1.

Rigid support frame 40 of the illustrated embodiment may best be appreciated by reference to both FIGS. 1 and 2 together, which have a common numbering of their elements. All references to side of the illustrated embodiment refer to the direction when facing the front of the chair, as shown in FIGS. 1 and 3. On each of the left and right sides of rigid support frame 40, a pair of upright support bars 42 are connected to a lower side support bar 44 by means of a T-corner connector 52, with the middle opening of T-corner connectors 52 being attached to lower side support bar 44.

A foot 58 is attached to the remaining opening of each T-corner connector 52, to allow rigid support frame 40 to rest on the ground. A variety of feet 58 may be utilized, and may be equipped with a variety of means for stabilizing rigid support frame 40, including rubber elements, screw holes for screwing the feet into the floor, and other means which will be obvious to those skilled in the art.

Each upright support bar 42 is further connected to an upper side support bar 46 parallel to the respective lower side support bar 44 by a three-way corner connector 54 and an elbow connector 56. Hence, each of the left and right sides of rigid support frame 40 are rectangular in shape, with a pair of parallel upright support bars 42 and a parallel pair of lower side support bar 44 and upper side support bar 46.

Each of the left and right sides of rigid support frame 40 are connected together by a rear support bar 48 connected to the remaining connector on each of the two three-way corner connectors 54. It has been found that this connection provides sufficient structural support for rigid support frame 40 when the elements used are of a strong metal such as iron or steel. However, it will be obvious to those skilled in the art that a variety of configurations for rigid support frame 40 may be used to provide sufficient structural support, and that rigid support frame 40 may be constructed of a variety of materials, as long as the overall structure has sufficient strength to support the users during vigorous sexual activity.

As an example of such different configurations of rigid support frame 40 consistent with the present invention, it has been found that different heights of vertical support bars 42 may correspond to different preferred certain sexual acts. Thus, using vertical support bars 42 of roughly a foot in height appears to be better suited for performing sexual intercourse, while using vertical support bars 42 of a greater height, such as one and a half to two feet, better facilitates oral-genital sexual activity. Further, different heights for vertical support bars 42 may be appropriate for differently sized individuals. Therefore, it will become obvious to those skilled in the art that a variety of heights of vertical support bars 42 may be used, depending upon the desired usage of the invention.

Flexible support structure 20 comprises four springs 22, with a pair of springs 22 connecting seat 10 with the right upper side support bar 46 and a pair of springs 22 connecting seat 10 with the left upper side support bar 46. Springs 22 are connected to upper side support bars 46 by ring fasteners 26 roughly concentric with upper side support bars 46.

The connection of springs 22 to seat 10 shown in the illustrated embodiment uses two different approaches. One spring 22 on each of the left and right sides is connected to a respective rear eyebolt 34. Rear eyebolts 34 each enter the seat 10 through a rear hole 12, which in the case of ordinary toilet seats is used for affixing the toilet seat to the toilet bowl. Rear eyebolts 34 are connected to each other by a rear eyebolt connector 36 (not shown). Rear eyebolt connector 36 is a hole with internal threading to permit rear eyebolts 34 to be screwed into rear eyebolt connector 36. In this manner both rear eyebolts 34 are connected to each other, with the eye portion of each extending from rear hole 12, with rear eyebolt connector 36 being disposed within rear hole 12 of seat 10.

The remaining two springs 22 are attached to seat 10 by means of front eyebolts 32, as best illustrated in FIG. 3. Front eyebolts 32 are disposed beneath seat 10, and are screwed into seat 10 through a pair of holes 14, one on each side of seat 10. Each front eyebolt 32 is then fixed at the top of seat 10 by a nut fastener 26. Nut fastener 26 and front eyebolt 32 are disposed as to make the top of seat 10 as flush as possible, although countersinking nut fasteners 26 may structurally undermine seat 10 and is therefore not presently used in the illustrated preferred embodiment of the present invention.

Also, although the front eyebolts 32 are illustrated as disposed perpendicular to seat 10, they may also be bent sideways to make them more closely parallel to springs 22. Further changes in orientation may be made consistent with the present invention, as will be obvious to those skilled in the art.

While the embodiment of the present invention illustrated in FIGS. 1–3 has a rigid support frame 40 in the form of a configuration of bars and joints, alternative support structures may be used to provide the necessary structural support for the users of the present invention consistent with the present invention.

Only one embodiment of a flexible support system 20 is illustrated; however, a variety of configurations will be obvious to those skilled in the art. For example, other flexible, elastic elements may be used in place of springs. Any flexible support elements may be used as long as it is strong enough to support the user during vigorous sexual activity, while being flexible enough to permit the seat to be displaced into a variety of positions. Also, alternative methods of attaching flexible support system 20 to seat 10 may be used consistent with the present invention, as will be obvious to those skilled in the art.

While the example illustrated above is the presently preferred embodiment of the present invention, various modifications will become obvious to those skilled in the art from the foregoing description and accompanying drawings. Accordingly, the present invention is to be limited solely to the scope of the following claims.

What is claimed is:

1. A chair for supporting a person during sexual intercourse comprising:

a rigid seat consisting of a single substantially flat plate having a front section and a middle section, said substantially flat plate having an opening therethrough in said middle section;

a rigid support frame supporting said rigid seat; and a flexible support system connected to said rigid seat and to said rigid support frame solely suspending said rigid seat from said rigid support frame, said flexible support system consisting of a plurality of elastic elements.

2. The chair of claim 1 wherein said opening in said middle section of said rigid seat extends to become an opening in and through said front section of said rigid seat.

3. The chair of claim 1 wherein said rigid seat comprises a toilet seat.

4. The chair of claim 1 wherein said rigid support frame further comprises a plurality of feet having screw holes for screwing said feet into the floor.

5. The chair of claim 1 wherein said rigid support frame further comprises a plurality of feet having rubber elements for stabilizing said rigid support frame on the ground.

6. A seat suspended from a rigid support structure comprising:

a rigid seat comprising a toilet seat; and a flexible support system connected to said rigid seat solely suspending said rigid seat from the rigid support structure, said flexible support system consisting of a plurality of elastic elements.

7. A chair for supporting a person during sexual intercourse consisting of:

a rigid seat comprising a toilet seat;

a rigid support frame supporting said rigid seat; and a flexible support system connected to said rigid seat and to said rigid support frame said flexible support system solely suspending said rigid seat from said rigid support frame, said flexible support system consisting of a plurality of elastic elements.

8. The chair of claim 7 wherein said toilet seat comprises a front section and a middle section, and wherein said middle section has an opening extending to become an opening in and through said front section of said rigid seat.

9. The chair of claim 7 wherein said rigid support frame further comprises a plurality of feet having screw holes for screwing said feet into the floor.

10. The chair of claim 7 wherein said rigid support frame further comprises a plurality of feet having rubber elements for stabilizing said rigid support frame on the ground.

* * * * *